US006304038B1

(12) United States Patent
Ide et al.

(10) Patent No.: US 6,304,038 B1
(45) Date of Patent: Oct. 16, 2001

(54) APPARATUS FOR DRIVING A DISPLAY PANEL

(75) Inventors: Shigeo Ide, Nakakoma-gun; Takashi Iwami, Fukuroi, both of (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/606,956

(22) Filed: Jun. 30, 2000

(30) Foreign Application Priority Data

Jul. 2, 1999 (JP) ..... 11-189676

(51) Int. Cl.[7] ..... G09G 3/10

(52) U.S. Cl. ..... 315/169.1; 315/169.3; 345/80; 345/55; 345/204; 345/212

(58) Field of Search ..... 315/169.1, 169.3, 315/169.4; 345/41, 42, 55, 60, 61, 67, 80, 204, 212

(56) References Cited

U.S. PATENT DOCUMENTS 5,517,207 * 5/1996 Kawada et al. ..... 345/78
5,739,641 * 4/1998 Nakamura ..... 315/169.1
5,943,030 * 8/1999 Minamibayashi ..... 345/60
6,072,447 * 6/2000 Noborio ..... 345/60
6,215,463 * 4/2001 Matsumoto et al. ..... 345/80

* cited by examiner

*Primary Examiner*—Haissa Philogene
(74) *Attorney, Agent, or Firm*—Sughrue, Mion, Zinn, Macpeak & Seas, PLLC

(57) ABSTRACT

A driving apparatus of a display panel permits an electric power consumption at the time of generation of a pixel data pulse can be reduced. Charges stored in a capacitor are discharged and supplied to a power line. Subsequently, a power potential is applied to the power line and, thereafter, charges stored on column electrodes of the display panel are charged into the capacitor via the power line. Finally, the power line is connected to the ground only for a short predetermined period of time. By connecting the power line and the column electrodes only for a predetermined period of time in accordance with a video signal, the pixel data pulses are applied to the column electrodes.

3 Claims, 5 Drawing Sheets

APPARATUS FOR DRIVING A DISPLAY PANEL

BACKGROUND OF THE INVENTION

1. Field of the Invention

The invention relates to an apparatus for driving a display panel such as AC driving type plasma display panel or electroluminescence display panel.

2. Description of Related Art

Recently, display apparatuses using a display panel have been put into practical use as a wall-mounted TV. Examples of such display panels are a plasma display panel, and an electroluminescence display panel, or the like in which capacitive light emitting devices are arranged in the form of a matrix.

There, however, is a problem that when pixel data pulses are applied to column electrodes of a display panel such as plasma display panel or electroluminescence display panel having the capacitive light emitting devices, a charge or a discharge is created, due to a parasitic capacitance existing between the column electrodes, by a potential difference occurring between the column electrodes, so that a reactive power is consumed.

When the number of column electrodes is increased to display a high quality television image, the number of pixel data pulses to be applied to the column electrodes also increases in accordance with the increased number of columns. When this occurs, electric power consumption also increases. A driving apparatus, therefore, which can apply the pixel data pulses to the display panel while suppressing the electric power consumption is demanded at present.

OBJECT AND SUMMARY OF THE INVENTION

It is an object of the invention to provide a driving apparatus of a display panel, in which electric power consumption at the time a pixel data pulse is generated can be reduced.

According to the invention, there is provided a driving apparatus for a display panel having a plurality of row electrodes and a plurality of column electrodes arranged so as to cross the row electrodes, in which a pixel data pulse corresponding to a video signal is applied to each of the column electrodes of the display panel, comprising: a power supply circuit which comprises a capacitor, a first switching current path for selectively discharging charges stored in the capacitor and supplying them to a power line, a second switching current path for selectively applying a power potential to the power line, a third switching current path for selectively charging the charges stored on the column electrodes into the capacitor via the power line, and a fourth switching current path for selectively connecting the power line to the ground only for a short predetermined period of time; and a pixel data pulse generating circuit for generating the pixel data pulses onto the column electrodes by connecting the power line with the column electrodes only for a predetermined period of time in response to the video signal.

DETAILED DESCRIPTION OF THE PREFERRED EMBODIMENT

Prior to describing an embodiment in detail, a construction and a driving method of a conventional plasma display panel will be described in detail with reference to the drawings.

Figure 1:
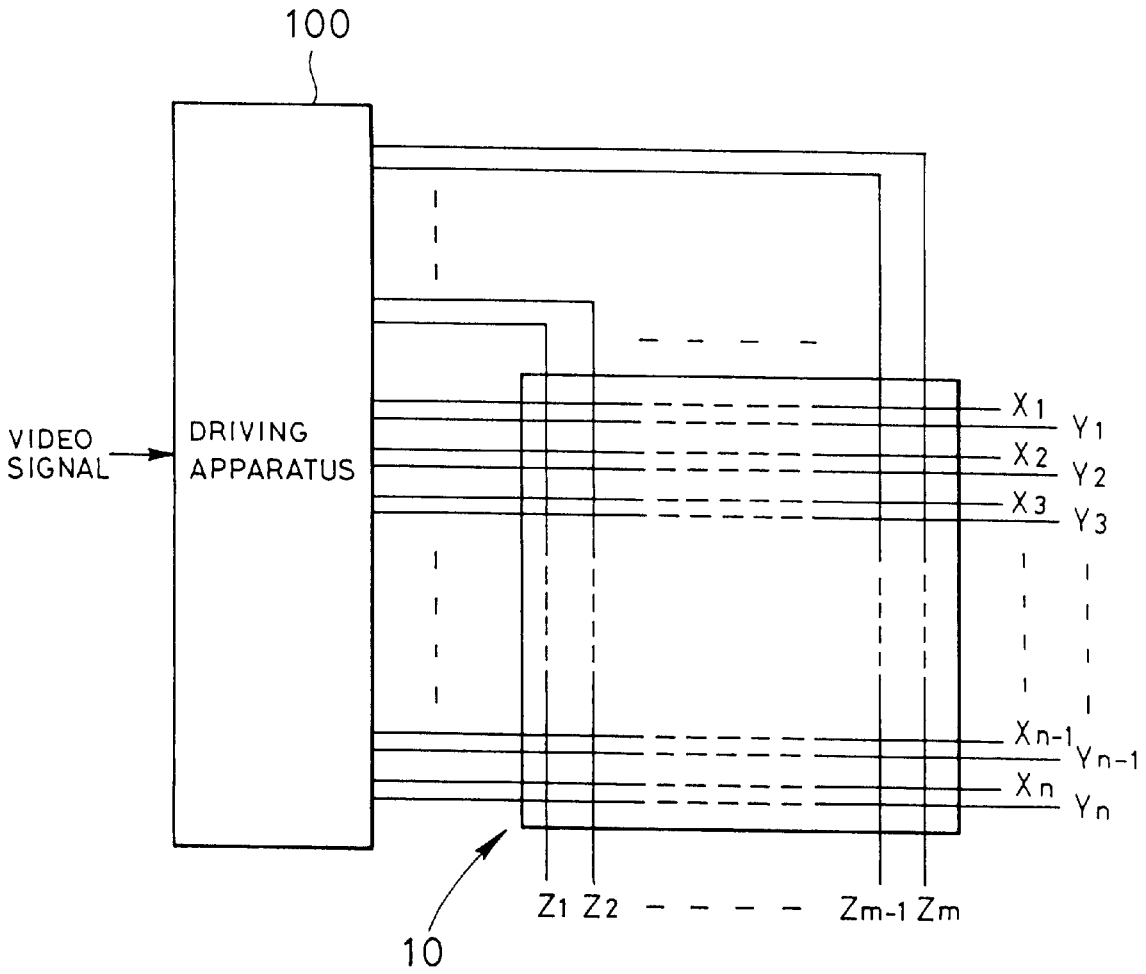
FIG. 1 is a diagram showing a schematic construction of a plasma display apparatus using a plasma display panel as a flat display panel.

FIG. 1 is a diagram showing a schematic construction of a display apparatus using a plasma display panel.

In FIG. 1, a PDP 10 as a plasma display panel has row electrodes $Y_1$ to $Y_n$ and $X_1$ to $X_n$ in which a row electrode pair corresponding to each row (the first to the nth rows) of one screen is formed by a pair of X and Y. Further, column electrodes $Z_1$ to $Z_m$ corresponding to respective columns (the first to the mth columns) of one screen are formed on the PDP 10 so as to cross the row electrode pairs perpendicularly and sandwich a dielectric material layer and a discharge space (not shown). A discharge cell serving as one pixel is formed in a crossing portion of one row electrode pair (X, Y) and one column electrode Z.

Each discharge cell has only two states. A first state of "light emission" and a second state of "non-light emission" depending on whether a discharge has occurred in the discharge cell or not. That is, only the luminances of two gradations of the lowest luminance (non-light emitting state) and the highest luminance (light emitting state) can be expressed.

For the PDP 10 having the light emitting devices, a driving apparatus 100 executes a gradation driving using a subfield method in order to obtain the luminance of the halftone corresponding to a supplied video signal.

According to the subfield method, the supplied video signal is converted into corresponding pixel data of N bits every pixel and a display period of one field is divided into N subfields in correspondence to each bit digit of those N bits. The number of times of discharge execution corresponding to a weight of the subfield is allocated to each subfield. The discharge is selectively caused or initiated only in the subfield according to the video signal. In this instance, the halftone luminance corresponding to the video signal is obtained by the total (in one field display period) number of times of discharge caused in each subfield.

A selective erasure address method is known as a method of actual gradation-driving the PDP by using the subfield method.

Figure 2:
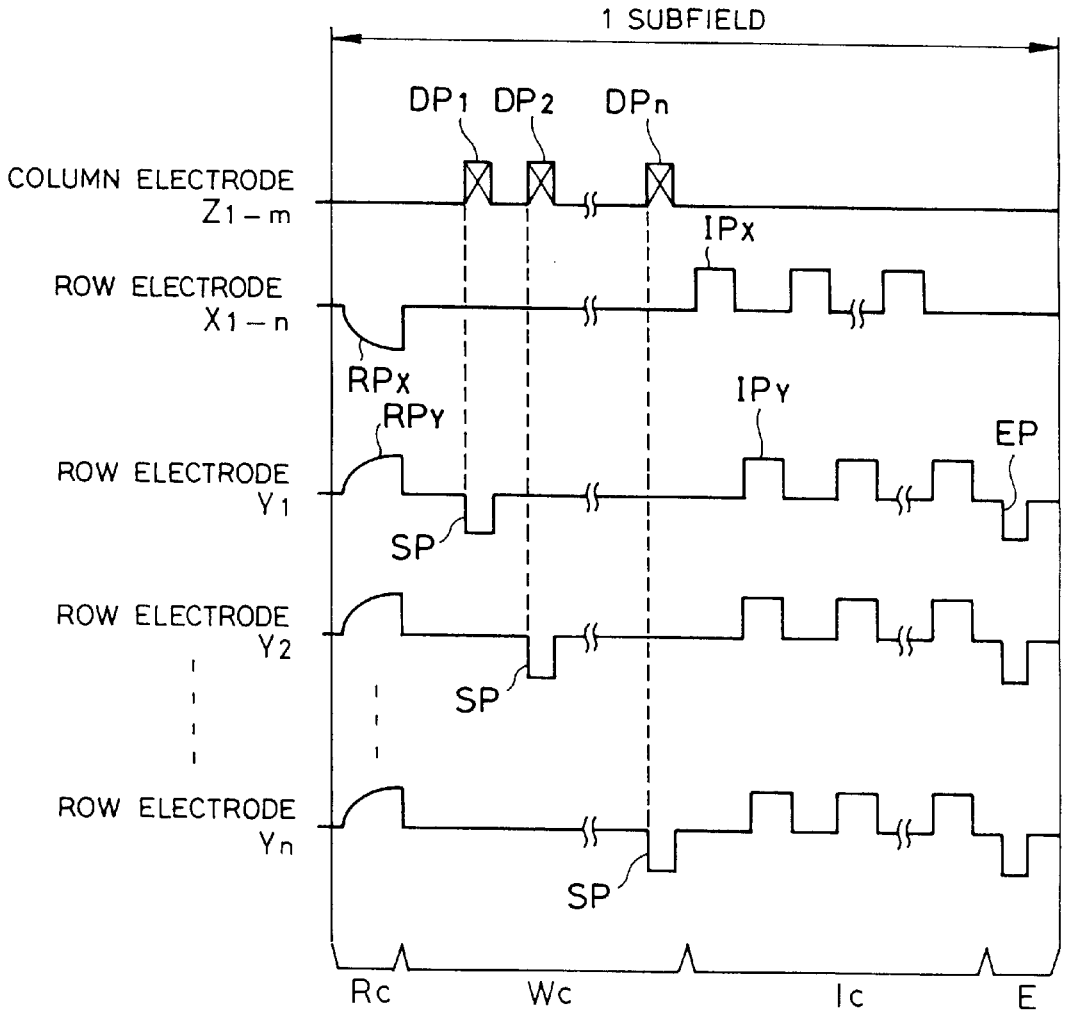
FIG. 2 is a diagram showing application timings of various drive pulses to be applied to a PDP 10 in one subfield.

FIG. 2 is a diagram showing application timings of various drive pulses to be applied by the driving apparatus 100 to the column electrodes and row electrodes of the PDP 10 in one subfield when the gradation driving based on the selective erasure address method is executed.

First, the driving apparatus 100 simultaneously applies a reset pulse $RP_X$ of a negative polarity to the row electrodes $X_1$ to $X_n$ and, further, a reset pulse $RP_Y$ of a positive polarity to the row electrodes $Y_1$ to $Y_n$ (all-resetting step Rc).

All discharge cells in the PDP 10 are reset-discharged in response to the applying of the reset pulses RPX and RPY and wall charges of a predetermined amount are uniformly formed in each discharge cell. All of the discharge cells are, thus, temporarily initially set to the "light emitting cells".

The driving apparatus 100 subsequently converts the supplied video signal into pixel data of, for example, 8 bits of each pixel. The driving apparatus 100 obtains pixel data bits by dividing the pixel data every digit bit and generates a pixel data pulse having a pulse voltage according to a logic level of the pixel data bit. Pixel data pulse groups $DP_1$ to $DP_n$ corresponding to the first to nth rows are formed by grouping the pixel data pulses every row (m pulses). The driving apparatus 100 sequentially applies the pixel data pulse groups $DP_1$ to $DP_n$ to the column electrodes $Z_{1-m}$ as shown in FIG. 2. The driving apparatus 100 generates a pixel data pulse which is at a high voltage when the pixel data bit is set to, for example, logic level "1" and at a low voltage (0 volt) when the pixel data bit is set to logic level "0". The driving apparatus 100 further generates scan pulses SP as shown in FIG. 2 at the applying timing of each of the pixel data pulse groups DP and sequentially applies the pixel data pulse groups to the row electrodes $Y_1$ to $Y_n$ (pixel data writing step Wc).

In this instance, a discharge (selective erasure discharge) occurs only in the discharge cells in crossing portions of the "rows" to which the scan pulse SP has been applied and the "columns" to which the high voltage pixel data pulse has been applied and the wall charges remaining in those discharge cells are selectively erased. The discharge cells initialized to the status of the "light emitting cell" in the all-resetting step Rc are, consequently, shifted to the "non-light emitting cells". The selective erasure discharge as mentioned above is not caused in the discharge cells formed so as to cross the "rows" and "columns" to which the pixel data pulses of the low voltage have been applied, although the scan pulses SP have been applied to the discharge cells. The status initialized in the all-resetting step Rc, namely, the status of the "light emitting cells" is held.

The driving apparatus 100 subsequently repetitively applies a sustain pulse $IP_X$ of a positive polarity as shown in FIG. 2 to the row electrodes $X_1$ to $X_n$ and, for a period of time during which the sustain pulse $IP_X$ is not applied to the row electrodes $X_1$ to $X_n$, the driving apparatus repetitively applies a sustain pulse $IP_Y$ of a positive polarity as shown in FIG. 2 to the row electrodes $Y_1$ to $Y_n$ (light emission sustaining step Ic).

In this process, only the discharge cells in which the wall charges remain, namely, only the "light emitting cells" discharge (sustain discharge) every time the sustain pulses $IP_X$ and $IP_Y$ are alternately applied. That is, only the discharge cells set to the "light emitting cells" in the pixel data writing step Wc repeat the light emission due to the sustain discharge only the number of times corresponding to the weight of this subfield and sustain the light emitting state. The number of times of applying the sustain pulses IPX and $IP_Y$ is the number of times which has previously been set in accordance with the weight of each subfield.

The driving apparatus 100 applies erasing pulses EP as shown in FIG. 2 to the row electrodes $Y_1$ to $Y_n$ (erasing step E). All of the discharge cells are, consequently, allowed to erasure-discharge in a lump, thereby extinguishing the wall charges remaining in each discharge cell.

By executing the series of operations as mentioned above a plurality of times in one field, the halftone luminance corresponding to the video signal can be derived by the sense of sight.

However, there is a problem that when the pixel data pulse is applied to the column electrodes of the display panel such as a plasma display panel, electroluminescence display panel, or the like having the capacitive light emitting devices as mentioned above, the charge or discharge is caused in the parasitic capacitance existing between the column electrodes due to the potential difference which occurs between the column electrodes, so that a reactive power is consumed.

If the number of column electrodes is increased to display a high quality television image, the number of pixel data pulses to be applied to the column electrodes is also increased in response to the increase in the number of column electrodes, so that an electric power consumption also increases.

Figure 3:
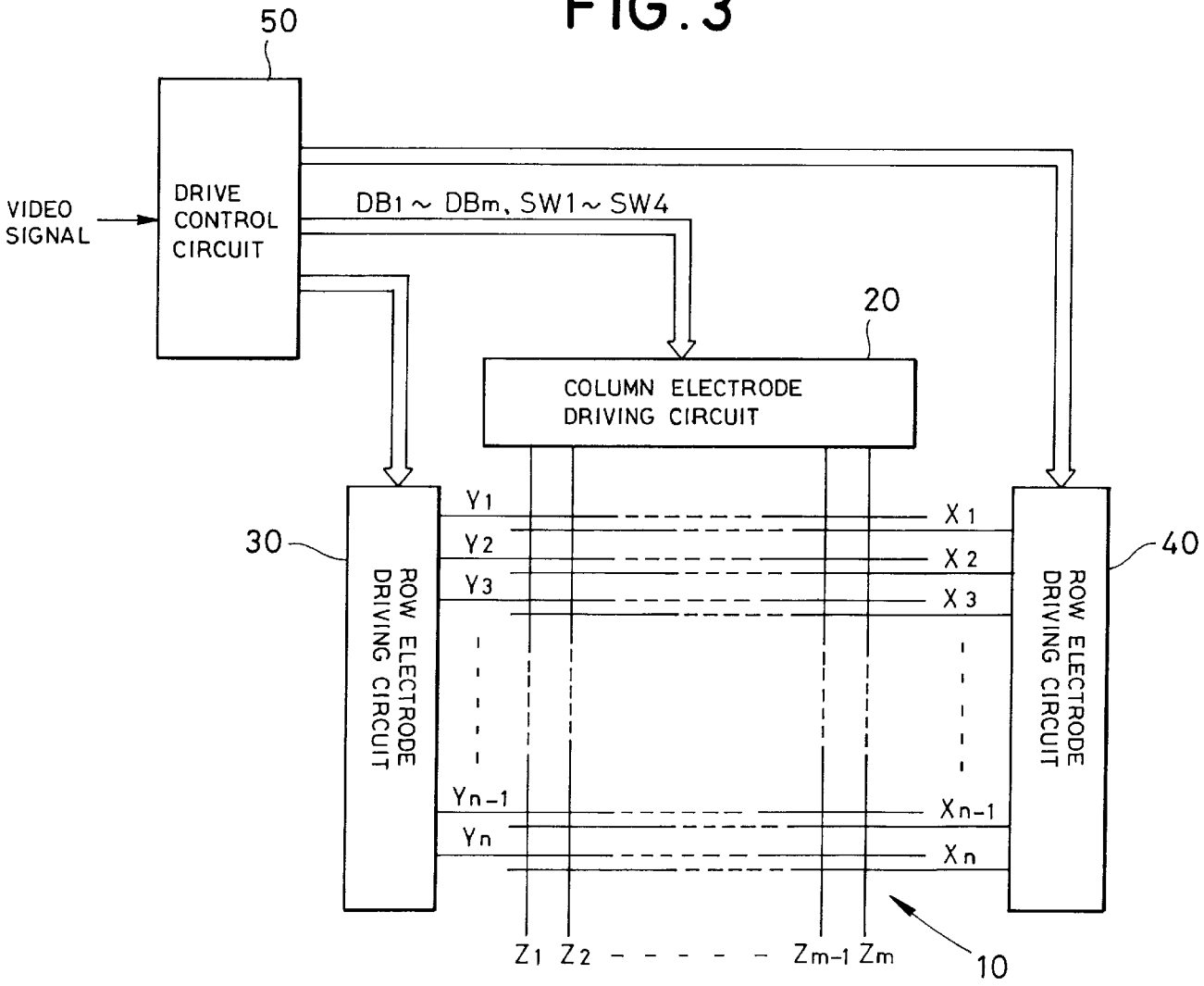
FIG. 3 is a diagram showing a construction of a display apparatus in which a driving apparatus according to the invention has been installed.

FIG. 3 is a diagram showing the structure of a display apparatus including the driving apparatus according to the invention.

In FIG. 3, the PDP 10 as a plasma display panel has the row electrodes $Y_1$ to $Y_n$ and $X_1$ to $X_n$ serving as row electrode pairs in which a row electrode pair corresponding to each row (the first to the nth rows) of one screen is formed by a X and Y pair. Further, the column electrodes $Z_1$ to $Z_m$ corresponding to respective columns (the first to the mth columns) of one screen are formed on the PDP 10 so as to perpendicularly cross the row electrode pairs and sandwich a dielectric material layer and a discharge space (not shown). A discharge cell serving as one pixel is formed in a crossing portion of one row electrode pair (X, Y) and one column electrode Z.

A drive control circuit 50 generates various timing signals for allowing the reset pulses $RP_X$ and $RP_Y$, scan pulses SP, and sustain pulses $IP_X$ and $IP_Y$ as shown in FIG. 2 to be generated and supplies them to each of row electrode driving circuits 30 and 40. The row electrode driving circuit 30 generates the reset pulse $RP_X$ and sustain pulse $IP_X$ in response to the timing signals and supplies them to the row electrodes $X_1$ to $X_n$ of the PDP 10 at the timings as shown in FIG. 2, respectively. The row electrode driving circuit 40 generates the reset pulse $RP_Y$, scan pulse SP, sustain pulse IPY, and erasing pulse EP in response to the various timing signals supplied from the drive control circuit 50 and supplies them to the row electrodes $Y_1$ to $Y_n$ of the PDP 10 at the timings as shown in FIG. 2, respectively.

Further, the drive control circuit 50 converts the supplied video signal into pixel data of, for example, 8 bits every pixel, divides the pixel data every digit bit, extracts the data bits corresponding to each of the first to nth rows for every row (m bits), and supplies the extracted data bits as pixel data bits $DB_1$ to $DB_m$ to the column electrode driving circuit 20. In this instance, the drive control circuit 50 generates switching signals SW1 to SW4 for generating the pixel data pulses according to the pixel data bits DB and supplies the pixel data pulses to a column electrode driving circuit 20.

Figure 4:
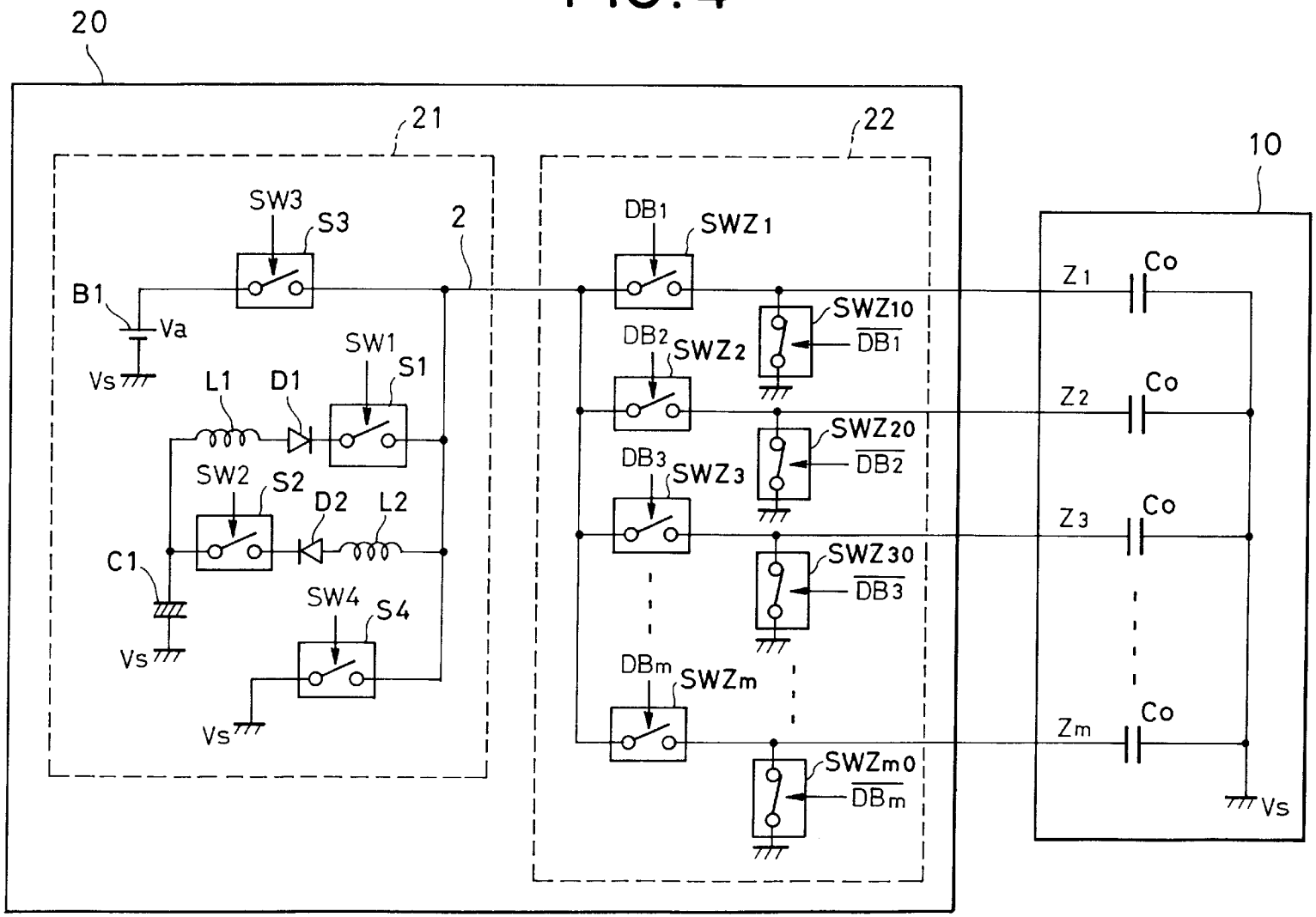
FIG. 4 is a diagram showing an internal construction of a column electrode driving circuit 20.

FIG. 4 is a diagram showing an internal structure of the column electrode driving circuit 20.

As shown in FIG. 4, the column electrode driving circuit 20 includes a power supply circuit 21 and a pixel data pulse generating circuit 22.

One end of a capacitor C1 in the power supply circuit 21 is connected to a PDP grounding potential Vs as a grounding potential of the PDP 10. A switching device S1 is turned off when the switching signal SW1 at the logic level "0" is supplied from the drive control circuit 50. When the logic level of the switching signal SW1 is set to "1", the switching device S1 is turned on, thereby allowing an electric potential developed at the other end of the capacitor C1 to be applied onto a power line 2 via a coil L1 and a diode D1. The capacitor C1, thus, starts to discharge and an electric potential developed by this discharge is applied to the power line 2. A switching device S2 is turned off when the switching signal SW2 at the logic level "0" is supplied from the drive control circuit 50. When the logic level of the switching signal SW2 is set to "1", the switching device S2 is turned on, thereby allowing the electric potential on the power line 2 to be applied to the other end of the capacitor C1 via a coil L2 and a diode D2. In this instance, the capacitor C1 is charged by the electric potential on the power line 2. A switching device S3 is turned off when the switching signal SW3 at the logic level "0" is supplied from the drive control circuit 50. When the logic level of the switching signal SW3 is set to "1", the switching device S3 is turned on, thereby allowing a power potential Va derived from a DC power source B1 to be applied onto the power line 2. A negative terminal of the DC power source B1 is connected to the PDP grounding potential Vs. A switching device S4 is turned off when the switching signal SW4 at the logic level "0" is supplied from the drive control circuit 50. When the logic level of the switching signal SW4 is set to "1", the switching device S4 is turned on, thereby connecting the power line 2 to the PDP grounding potential Vs.

Switching devices $SWZ_1$ to $SWZ_m$ and $SWZ_{10}$ to $SWZ_{m0}$ which are independently on/off controlled in accordance with the (m) pixel data bits $DB_1$ to $DB_m$ of one row supplied from the drive control circuit 50 are provided for the pixel data pulse generating circuit 22, respectively. Each of the switching devices $SWZ_1$ to $SWZ_m$ is turned on only when each pixel data bit DB supplied thereto is set to logic level "1" and applies the electric potential developed on the power line 2 to each of the column electrodes $Z_1$ to $Z_m$ of the PDP 10. Each of the switching devices $SWZ_{10}$ to $SWZ_{m0}$ is turned on only when each pixel data bit DB supplied thereto is set to logic level "0", and connects the electric potential on the column electrodes to the PDP grounding potential Vs.

Figure 5:
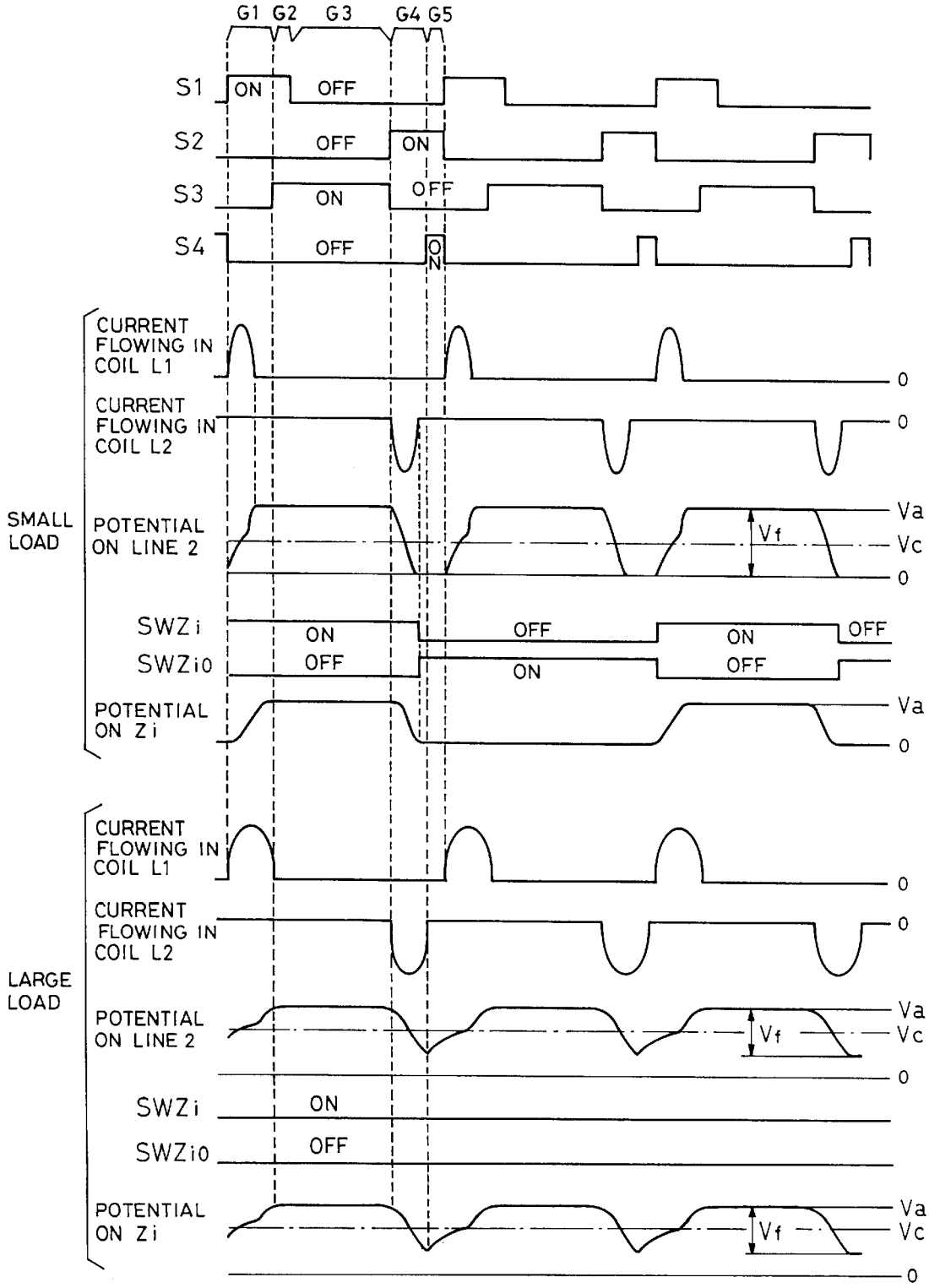
FIG. 5 is a diagram for explaining the internal operation of the column electrode driving circuit 20.

FIG. 5 is a diagram showing internal operation waveforms of the column electrode driving circuit 20.

When a load in the PDP 10 is large, namely, when the pixel data pulses of high voltage are continuously applied to the column electrodes $Z_i$ (i=1 to m), as shown in the part B of FIG. 5, the switching devices $SWZ_i$ (i=1 to m) are turned on and the switching devices $SWZ_{i0}$ (i=1 to m) are turned off.

The drive control circuit 50 supplies the switching signals SW2 to SW4 of logic level "0" and the switching signal SW1 of the logic level "1" to the power supply circuit 21 (driving step G1).

Only the switching device S1 among the switching devices S1 to S4 is, thus, turned on and the charges stored in the capacitor C1 are discharged. A current, therefore, flows to the column electrodes $Z_i$ via the coil L1, diode D1, switching device S1, and switching devices $SWZ_i$ and a load capacitor $C_0$ is charged. In this instance, an electric potential of the column electrode $Z_i$ gradually rises as shown in the part B of FIG. 5 according to a time constant which is determined by the coil L1 and load capacitor $C_0$.

When the half period of a resonance period due to the coil L1 and load capacitor has elapsed, the drive control circuit 50 switches only the switching signal SW3 to logic level "1" (driving step G2). The switching device S3 is, thus, turned on, the power potential Va by the DC power source B1 is applied onto the power line 2, and the potential of the column electrode $Z_i$ is fixed to the power potential Va.

The drive control circuit 50 subsequently switches the switching signal SW1 to logic level "0" (driving step G3). The switching device S1 is, thus, turned off, the resonance operation by the coil L1 and load capacitor $C_0$ is stopped.

The drive control circuit 50 subsequently switches the switching signal SW2 to logic level "1" and switches the switching signal SW3 to logic level "0" (driving step G4). The charges stored in the load capacitor $C_0$ are thus discharged. A current, consequently, flows to the capacitor C1 via the switching device $SWZ_i$, coil L2, diode D2, and switching device S2 and the capacitor C1 is charged. In this instance, the potential of the column electrode $Z_i$ gradually decreases as shown in the part B of FIG. 5 according to a time constant which is decided by the coil L2 and load capacitor $C_0$.

When the half period of the resonance period due to the coil Ll and load capacitor has elapsed, the drive control circuit 50 supplies the switching signal SW4 of logic level "1" of a short pulse to the power supply circuit 21 in order to turn on the switching device 54 only for a short predetermined period (driving step G5).

The power line 2 is, thus, connected to the PDP grounding potential Vs only for the short period of time. In this instance, although the current is supplied from the PDP 10 to the switching device S4 via the switching device $SWZ_i$ and power line 2, the ON period of the switching device S4 is set to be short so as to limit the current flowing into the switching device S4 lest the potential on the power line 2 completely drops to 0 [V]. As shown in the part B of FIG. 5, an amplitude Vf of the potential waveform on the power line 2 is smaller than that in the case where the load is small, namely, the case where the pixel data pulses of the high voltage are discontinuously applied to the column electrode $Z_i$.

By the series of operations comprising the driving steps G1 to G5, the power supply circuit 21 generates a power potential having a potential fluctuation as shown in the part B of FIG. 5 and continuously applies it as a high voltage pixel data pulse to the column electrode $Z_i$ via the power line 2 and switching device $SWZ_i$.

As mentioned above, when the load in the PDP 10 is large, the current flowing into the switching device S4 is limited lest the potential on the power line 2 completely drops to 0 [V] and the amplitude of the potential change that is caused on the power line 2 is reduced, thereby enabling the electric power consumption to be reduced.

When the load in the PDP 10 is small, namely, when the high voltage pixel data pulses are discontinuously applied to the column electrode $Z_i$, the power potential having a potential fluctuation as shown in the part A of FIG. 5 is generated.

When the pixel data bit DB is at logic level "1", the switching device $SWZ_i$ of the pixel data pulse generating circuit 22 is turned on and the switching device $SWZ_{i0}$ is turned off. When the pixel data bit DB is at logic level "0", the switching device $SWZ_i$ of the pixel data pulse generating circuit 22 is turned off and the switching device $SWZ_{i0}$ is turned on.

When the pixel data bit DB is switched from logic level "1" to logic level "0", the switching device $SWZ_{i0}$ is turned on, the column electrode $Z_i$ is connected to the ground, and the potential of the column electrode $Z_i$ is fixed to 0 [V].

When the pixel data bit DB is switched from logic level "0" to logic level "1", the switching device $SWZ_i$ is turned on and the switching device $SWZ_{i0}$ is turned off.

Simultaneously with the turn-on of the switching device $SWZ_i$, only the switching device S1 is turned on, and the charges stored in the capacitor C1 are discharged. As a result, the current flows to the column electrode $Z_i$ via the coil L1, diode D1, switching device S1, and switching device $SWZ_i$ and the load capacitor $C_0$ is charged. In this process, the electric potential of the column electrode $Z_i$ gradually rises as shown in the part A of FIG. 5 according to a time constant which is determined by the coil L1 and load capacitor $C_0$.

When the half period of the resonance period due to the coil L1 and load capacitor has elapsed, the switching signal SW3 is turned on, the power potential Va by the DC power source B1 is applied to the power line 2, and the potential of the column electrode $Z_i$ is fixed to the power potential Va.

Subsequently, the switching device S1 is turned off and the resonance operation by the coil L1 and load capacitor $C_0$ is stopped.

The drive control circuit 50 subsequently turns on the switching device S2 and turns off the switching device S3. The charges stored in the load capacitor $C_0$ are discharged. The current, therefore, flows to the capacitor C1 via the switching device $SWZ_i$, coil L2, diode D2, and switching device S2 and the capacitor C1 is charged. In this instance, the electric potential of the column electrode $Z_i$ gradually decreases as shown in the part B of FIG. 5 according to a time constant which is determined by the coil L2 and load capacitor $C_0$.

Subsequently, when the half period of the resonance period due to the coil L1 and load capacitor has elapsed, the switching device S4 is turned on only for a short predetermined period of time and the switching device $SWZ_{i0}$ is turned off.

The discontinuous pixel data pulses are applied to the column electrodes $Z_i$ by the above series of operations.

As mentioned above, when the current is large, the power supply circuit 21 first selectively discharges the charges stored in the capacitor C1 by a first switching current path comprising the coil L1, diode D1, and switching device S1 and supplies (driving step G1) them to the power line 2, thereby forming a leading edge portion of the pixel data pulse. Subsequently, the power potential is applied (driving step G3) to the power line 2 by a second switching current path comprising the DC power source B1 and switching device S3, thereby generating the pulse voltage (Va) of the pixel data pulse. Subsequently, the charges stored in the load capacitor $C_0$ existing in the column electrode are selectively charged into the capacitor C1 via the power line 2 and collected (driving step G4) by a third switching current path comprising the coil L2, diode D2, and switching device S2, thereby forming a trailing edge portion of the pixel data pulse. Finally, the power line 2 is forcedly connected to the ground only for a short predetermined period (driving step G5) by the switching device S4 as a fourth switching current path, thereby deciding the lowest potential as a pixel data pulse.

According to the invention as described in detail above, by collecting the charges stored in the display panel via the power line, the trailing edge portion of the pixel data pulse is formed and, further, by using the collected charges, the leading edge portion of the pixel data pulse is formed. In this instance, the lowest potential of the pixel data pulse is determined by forcedly connecting the power line to the ground only for a short period of time.

According to the apparatus for driving a display panel according to the invention, when the pixel data pulse is generated, the main charging/discharging operations between the parasitic capacitors existing in the column electrodes and the surplus current flowing from the display panel to the driving apparatus side are suppressed, so that the electric power consumption is reduced.

What is claimed is:

1. A driving apparatus of a display panel having a plurality of row electrodes and a plurality of column electrodes arranged so as to cross said row electrodes, in which pixel data pulses corresponding to a video signal are applied to each of said column electrodes of said display panel, comprising:

a power supply circuit which comprises a capacitor, a first switching current path for selectively discharging charges stored in said capacitor and supplying them to a power line, a second switching current path for selectively applying a power potential to said power line, a third switching current path for selectively charging the charges stored on said column electrodes into said capacitor via said power line, and a fourth switching current path for selectively connecting said power line to the ground only for a short predetermined period of time; and a pixel data pulse generating circuit for applying said pixel data pulses to said column electrodes by connecting said power line with said column electrodes only for a predetermined period of time in response to said video signal.

2. An apparatus according to claim 1, wherein said first switching current path comprises a first coil whose one end is connected to one end of said capacitor and a first switching device for applying an electric potential developed at the other end of said first coil to said power line, and said third switching current path comprises a second coil whose one end is connected to said power line and a second switching device for connecting the other end of said second coil to said one end of said capacitor.

3. An apparatus according to claim 1, wherein a duration of said predetermined short period of time is determined to be short enough to create an effect to limit a current flowing through said fourth switching current path is when said pixel data pulses are continuously applied to said column electrodes.

* * * * *